US010912154B1

(12) United States Patent
Brown

(10) Patent No.: US 10,912,154 B1
(45) Date of Patent: Feb. 2, 2021

(54) CONCRETE HEATING SYSTEM

(71) Applicant: Michael E. Brown, Bottineau, ND (US)

(72) Inventor: Michael E. Brown, Bottineau, ND (US)

( * ) Notice: Subject to any disclaimer, the term of this patent is extended or adjusted under 35 U.S.C. 154(b) by 0 days.

(21) Appl. No.: 16/986,981

(22) Filed: Aug. 6, 2020

(51) Int. Cl.

| | |
|---|---|
| ***H05B 3/03*** | (2006.01) |
| ***H05B 3/12*** | (2006.01) |
| ***H05B 3/18*** | (2006.01) |
| ***H05B 1/02*** | (2006.01) |
| ***E01H 5/10*** | (2006.01) |
| ***H05B 3/00*** | (2006.01) |

(52) U.S. Cl.
CPC ..... *H05B 3/18* (2013.01); *E01H 5/10* (2013.01); *H05B 1/0202* (2013.01); *H05B 3/0004* (2013.01); *H05B 3/03* (2013.01); *H05B 2203/002* (2013.01); *H05B 2203/017* (2013.01); *H05B 2214/02* (2013.01)

(58) Field of Classification Search
None
See application file for complete search history.

(56) References Cited

U.S. PATENT DOCUMENTS

| | | | | |
|---|---|---|---|---|
| 3,377,462 | A * | 4/1968 | Pferschy | E01C 11/265 219/213 |
| 3,573,427 | A | 4/1971 | Minsk | |
| 3,742,192 | A | 6/1973 | Brzuszek | |
| 3,924,098 | A * | 12/1975 | Dunn | H05B 3/14 219/553 |
| 4,058,982 | A | 11/1977 | Wright | |
| 4,301,356 | A * | 11/1981 | Tanei | F24D 13/024 219/213 |
| 6,569,296 | B1 | 5/2003 | Burgher | |
| 6,673,309 | B1 | 1/2004 | Watanabe | |
| 6,825,444 | B1 | 11/2004 | Tuan | |
| 2003/0173072 | A1 * | 9/2003 | Vinegar | B09C 1/02 166/66.5 |
| 2007/0186824 | A1 | 8/2007 | Takahashi | |
| 2008/0272106 | A1 | 11/2008 | Naylor | |
| 2010/0089584 | A1 * | 4/2010 | Burns | H01C 3/00 166/302 |

(Continued)

FOREIGN PATENT DOCUMENTS

| | | | | |
|---|---|---|---|---|
| FR | 2485860 | A2 * | 12/1981 | H05B 3/60 |
| FR | 2511485 | A1 * | 2/1983 | F24D 13/024 |

(Continued)

*Primary Examiner* — Joseph M. Pelham
(74) *Attorney, Agent, or Firm* — Neustel Law Offices

(57) ABSTRACT

A concrete heating system for electrically melting snow and ice. The concrete heating system generally includes a heating device for embedding in conductive concrete, the device having a spacing member and a plurality of electrically isolated conductors extending outward at an angle from the spacing member along its length. The device also includes a first electrode near the first end of the spacing member, and a second electrode extending outward from the spacing member at the second end. The plurality of conductors conduct an electrical current between the first electrode and the second electrode when the concrete heating device is embedded in conductive concrete and the power source applies a voltage between the first electrode and the second electrode.

20 Claims, 11 Drawing Sheets

(56) References Cited

U.S. PATENT DOCUMENTS

| | | | | |
|---|---|---|---|---|
| 2011/0064520 | A1 | 3/2011 | Bergstrom | |
| 2011/0252715 | A1* | 10/2011 | Aldraihem | E04B 1/98 52/1 |
| 2012/0018415 | A1* | 1/2012 | Song | H05B 3/283 219/213 |
| 2014/0069908 | A1* | 3/2014 | Yang | E01C 11/265 219/213 |
| 2018/0063889 | A1 | 3/2018 | Sedarous | |
| 2019/0119864 | A1* | 4/2019 | Tuan | E01C 11/265 |
| 2020/0262753 | A1* | 8/2020 | Ceylan | C04B 24/383 |

FOREIGN PATENT DOCUMENTS

| | | | | |
|---|---|---|---|---|
| GB | 1553497 | A * | 9/1979 | H05B 3/141 |
| WO | WO-2020097718 | A1 * | 5/2020 | H05B 3/286 |

* cited by examiner

CONCRETE HEATING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a concrete heating system for using electrical power to melt snow and ice that might otherwise accumulate on structures, such as driveways, roads, bridges, etc.

Related Art

Any discussion of the related art throughout the specification should in no way be considered as an admission that such related art is widely known or forms part of common general knowledge in the field.

Conductive concrete has been used to provide for electrical melting of ice and snow. However, it may in some cases be difficult to adjust the power level applied to a structure. In addition, it may be difficult to use electrical heating to keep only targeted parts of a structure free of ice and snow.

SUMMARY

An example embodiment is directed to a concrete heating system. The concrete heating system generally includes a concrete heating device for embedding in conductive concrete, the heating device comprising a spacing member having a first end and a second end and a length between the first end and the second end, a plurality of conductors extending outward from the spacing member along the length, each of the plurality of conductors being spaced from each other and extending outward such that an angle is formed between each conductor and the spacing member, a first electrode extending outward from the spacing member near the first end, the first electrode adapted for connection to a power source, and a second electrode extending outward from the spacing member, the second electrode being spaced apart from the first electrode and the plurality of conductors such that the plurality of conductors are positioned between the first electrode and the second electrode.

The second electrode is also adapted for connection to the power source. Typically, the conductors are not conductively coupled to each other or to the first or second electrode. The plurality of conductors conduct an electrical current between the first electrode and the second electrode when the concrete heating device is embedded in conductive concrete and the power source applies a voltage between the first electrode and the second electrode.

In some example embodiments of the heating system, the each conductor of the plurality of conductors is elongated and extends outward at a right angle to an axis of the spacing member that extends between the first end and the second end. Further, in some embodiments there may be two spacing members, a first spacing member and a second spacing member that is spaced apart from the first spacing member, and the first electrode, the second electrode, and the plurality of conductors may be elongated and extend between the first spacing member and the second spacing member. In still further embodiments, the first spacing member and the second spacing member are parallel to each other.

In another example embodiment, the first electrode, the second electrode, and the plurality of conductors may be parallel to each other and lie substantially in single row along the length of the first spacing member and the second spacing member. In embodiments where the first spacing member and the second spacing member are also parallel to each other, the heating device may form a ladder-like structure, where the electrodes and conductors form the rungs, and the spacing members form the sides or rails.

In another example embodiment of the concrete heating device of the system, the plurality of conductors are parallel to each other and lie substantially in two rows spaced apart from each other. Further, the first spacing member and the second spacing member of this embodiment may be parallel to each other.

In any embodiment described here, the first electrode and the second electrode are connectable to the power source by a first wire and a second wire conductively coupled to the first electrode and the second electrode. Further, the concrete heating device or system may further comprise a thermal switch connected in series with the first wire or the second wire such that the thermal switch selectively conducts or interrupts the electrical current that flows through the concrete heating device based on temperature.

Using the system may include the steps of embedding any example embodiment of the concrete heating device in conductive concrete, allowing the conductive concrete to cure, connecting the first wire and the second wire to the power source, and activating the power source such that a voltage is applied between the first electrode and the second electrode.

A method of using the system may also include allowing the conductive concrete to cure, such that it creates a conductive block, and the method may further include embedding the conductive block in non-conductive concrete. The conductive block provides heat that is transferred into the non-conductive concrete.

Another example embodiment of the system may include a prefabricated concrete heating element for embedding in concrete or other material, such as a concrete or blacktop structure. In such embodiments, any of the embodiments of heating devices described above or herein can be embedded in a cured, conductive concrete portion that surrounds the concrete heating device. This cured, conductive concrete element may then be further embedded in a cured, non-conductive concrete portion that at least partially surrounds the cured, conductive concrete portion, although the non-conductive portion may also completely surround the conductive portion. The prefabricated concrete heating element may also include an insulation layer that encloses the cured, non-conductive concrete portion and the cured, conductive concrete portion. As also described above, the plurality of conductors and the cured, conductive concrete portion conduct an electrical current between the first electrode and the second electrode when the power source applies a voltage between the first electrode and the second electrode.

The prefabricated concrete heating element may further comprise a first wire and a second wire extending from the prefabricated concrete heating element connected to the first electrode and the second electrode, respectively, the first wire and the second wire connectable to the power source. The prefabricated concrete heating element may further comprise a thermal switch positioned within the cured, non-conductive concrete portion and connected in series between the power source and the first electrode or the second electrode, such that the thermal switch selectively conducts or interrupts the electrical current that flows through the concrete heating device based on temperature.

The prefabricated concrete heating element can be in the shape of a hexahedron, a cylinder, or any other practical shape, which may depend on the concrete structure it is to be embedded in.

The prefabricated concrete heating element may be used by embedding the prefabricated concrete heating element in uncured concrete or other material, such as a larger concrete structure (e.g., driveway, a road, a bridge, a runway, etc.). The uncured concrete is allowed to cure, and the first wire and the second wire are connected to the power source, and the power source is activated such that the voltage is applied between the first electrode and the second electrode. The power source may be activated by a manual switch, a timer, a remote-controlled switch, or any other arrangement.

There has thus been outlined, rather broadly, some of the embodiments of the concrete heating system in order that the detailed description thereof may be better understood, and in order that the present contribution to the art may be better appreciated. There are additional embodiments of the concrete heating system that will be described hereinafter and that will form the subject matter of the claims appended hereto. In this respect, before explaining at least one embodiment of the concrete heating system in detail, it is to be understood that the concrete heating system is not limited in its application to the details of construction or to the arrangements of the components set forth in the following description or illustrated in the drawings. The concrete heating system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figure 1:
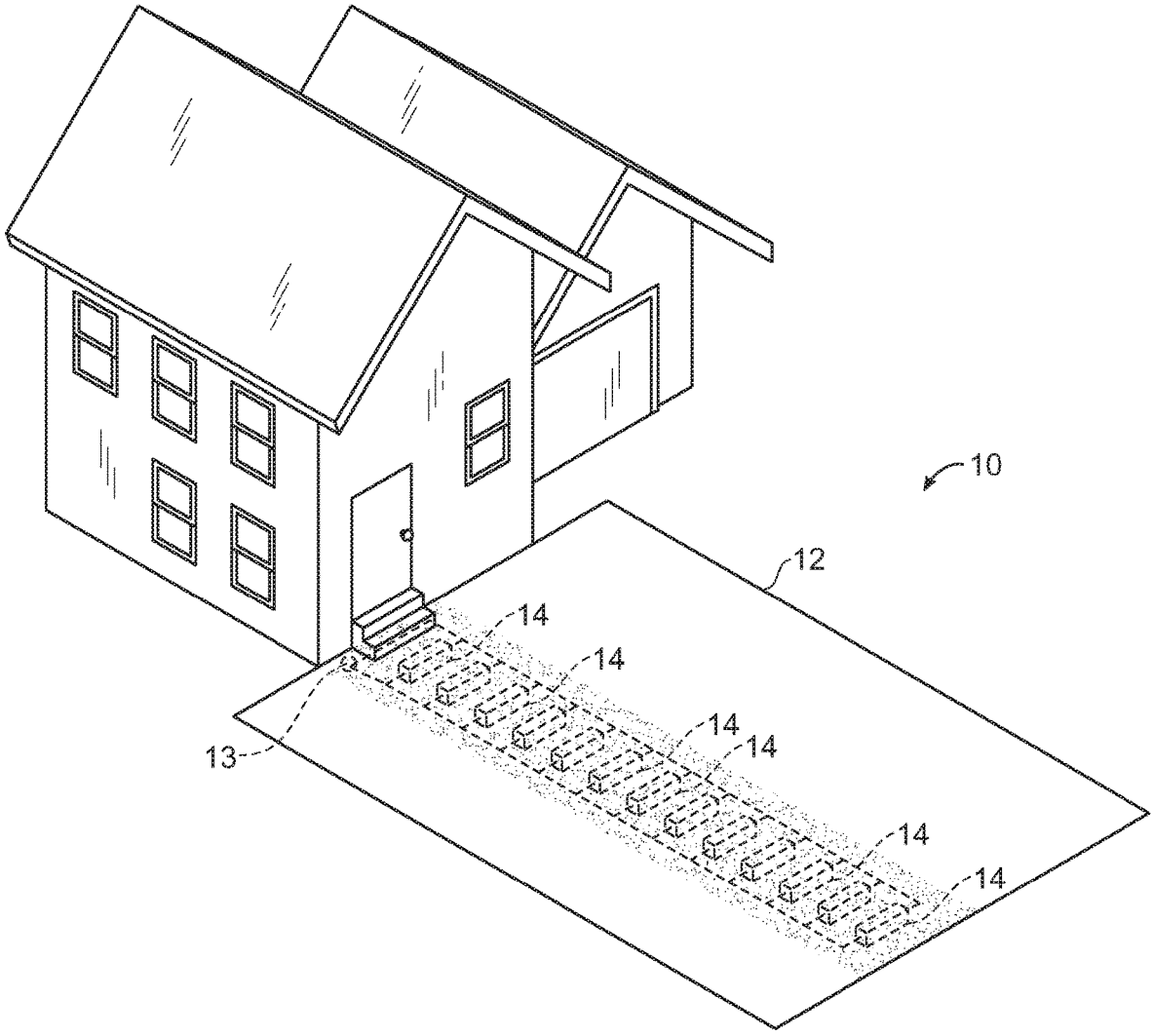
FIG. 1 is a perspective view of a concrete heating system in accordance with an example embodiment.

An example concrete heating system 10 generally comprises a concrete heating device 20 for embedding in conductive concrete 40, the heating device 20 comprising a spacing member 22, such as 22*a* or 22*b* in specific embodiments, the spacing member or members having a first end 21 and a second end 29, and a length between the first end 21 and the second end 29. Each device 20 may also include a plurality of conductors 25 extending outward from the spacing member 22 along its length, each of the conductors 25 being spaced from each other and extending outward from the spacing member such that an angle is formed between each conductor 25 and the spacing member 22.

Each concrete heating device 20 of the system 10 may also have a first electrode 24 extending outward from the spacing member 22 near the first end 21, the first electrode 24 adapted for connection to a power source, and a second electrode 23 extending outward from the spacing member 22, the second electrode 23 being spaced apart from the first electrode 24 and the conductors 25 such that the conductors are positioned between the first electrode and the second electrode, the second electrode adapted for connection to the power source. Typically, the conductors 25 are not conductively coupled to each other or to the first or second electrodes 24, 23. The conductors 25 conduct an electrical current between the first electrode 24 and the second electrode 23 when the concrete heating device is embedded in conductive concrete 40 and the power source applies a voltage between the first electrode 24 and the second electrode 23.

In some example embodiments of the heating system, the plurality of conductors 25 are elongated and extend outward at a right angle to an axis of the spacing member 22 that extends between the first end 21 and the second end 29. Further, in some embodiments there may be two spacing members 22, a first spacing member 22*a* and a second spacing member 22*b* that is spaced apart from the first spacing member 22*a*, and the first electrode 24, the second electrode 23, and the plurality of conductors 25 may be elongated and extend between the first spacing member 22*a* and the second spacing member 22*b*. In still further embodiments, the first spacing member 22*a* and the second spacing member 22*b* are parallel to each other.

In another example embodiment, the first electrode 24, the second electrode 23, and the plurality of conductors 25 may be parallel to each other and lie substantially in single row along the length of the first spacing member 22*a* and the second spacing member 22*b*. In embodiments where the first spacing member 22*a* and the second spacing member 22*b* are also parallel to each other, the heating device 20 may form a ladder-like structure, where the electrodes and conductors form the rungs, and the spacing members form the sides or rails.

In any embodiment described here, the first electrode 24 and the second electrode 23 are connectable to the power source by a first wire 26*a* and a second wire 26*b* conductively coupled to the first electrode 24 and the second electrode 23. Further, the concrete heating device or system may further comprise a thermal switch 27 connected in series with the first wire 26*a* or the second wire 26*b* such that the thermal switch 27 selectively conducts or interrupts the electrical current that flows through the concrete heating device 20 based on temperature.

B. Heating Device

The present heating system typically comprises one or more concrete heating devices 20 for embedding in conductive concrete 40 (see, e.g., FIG. 1), each heating device 20 comprising one or more spacing members 22, such as 22*a* and 22*b* in specific embodiments, as shown for example in FIGS. 2-7, each spacing member having a first end 21 and a second end 29, and a length between the first end 21 and the second end 29. The device may also include a plurality of conductors 25 extending outward from the spacing member 22 along its length, each of the conductors 25 being spaced from each other and extending outward from the spacing member such that an angle is formed between each conductor 25 and the spacing member 22. For example, as shown in FIGS. 2-4 and 7, each conductor 25 forms a right angle with each spacing member 22. Other angles are also possible.

Figure 6:
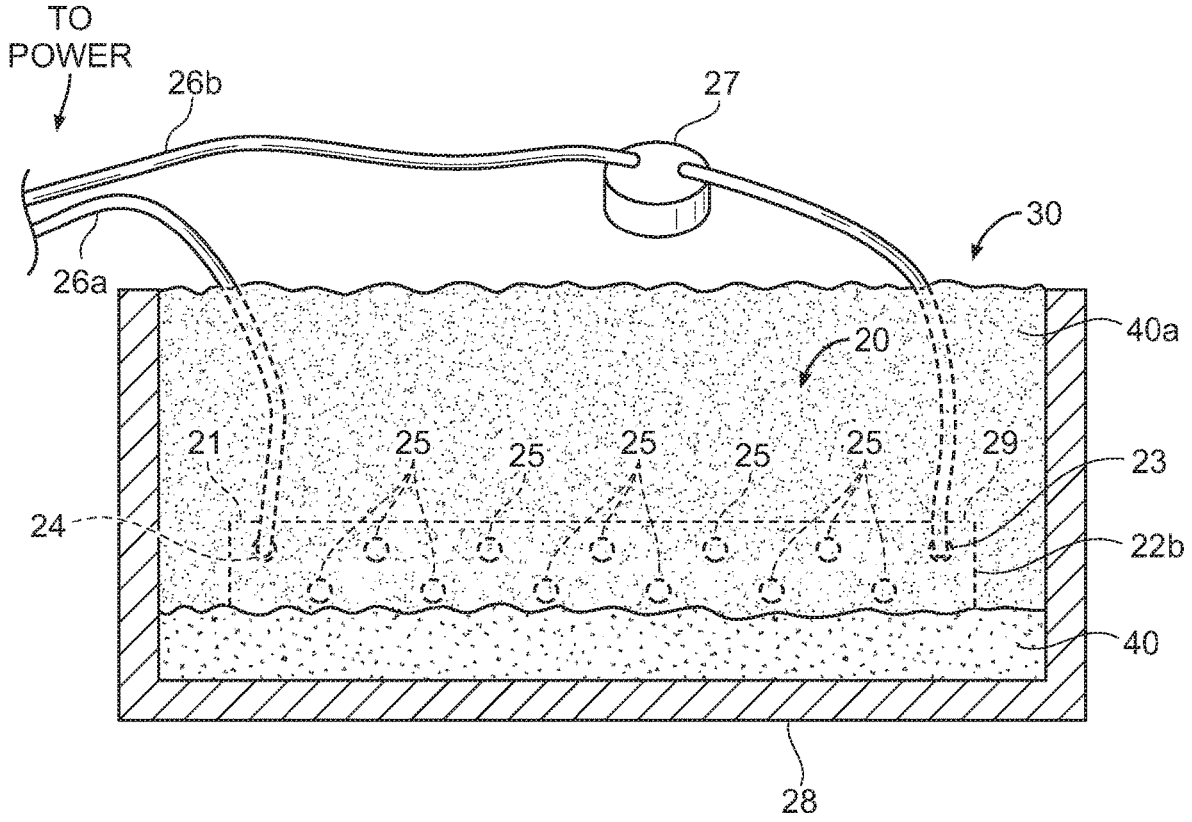
FIG. 6 is another cross section view of a heating device being embedded in conductive concrete for use in a concrete heating system in accordance with an example embodiment.

The concrete heating device may also have a first electrode 24 extending outward from the spacing member 22 near the first end 21, the first electrode 24 adapted for connection to a power source, and a second electrode 23 extending outward from the spacing member 22, the second electrode 23 being spaced apart from the first electrode 24 and the conductors 25 such that the conductors are positioned between the first electrode 24 and the second electrode 23, the second electrode 23 also adapted for connection to the power source. Typically, the conductors 25 are not conductively coupled to each other or to the first or second electrodes 24, 23. The conductors 25 conduct an electrical current between the first electrode 24 and the second electrode 23 when the concrete heating device is embedded in conductive concrete 40, as shown in FIG. 6, and the power source applies a voltage between the first electrode 24 and the second electrode 23.

The spacing between the conductors 25 affect the overall conductivity and power density of each block made with conductive concrete. In practice, a spacing of about ¼" between conductors has proven to work well, although spacing may be adjusted, as it may be affected by the characteristics of the conductive concrete. In one possible embodiment, shown for example in FIG. 2, the heating device 20 may be made in the general shape of form of a ladder, with electrodes 24 and 23 positioned at or near first end 21 and second end 29 of spacing members 22*a* and 22*b*. In this embodiment, the conductors 25 are parallel to each other and to electrodes 24 and 23, which combined form the "rungs" of the ladder-shaped structure. In this particular embodiment, the conductors 25 and electrodes 24, 23 are also evenly spaced along the length of spacing members 22*a* and 22*b*, although other configurations are also possible. As also shown, the device 20 of FIG. 2 may include a thermal control device, such as thermal switch 27, which may be embedded in either the conductive or nonconductive portion of concrete, and thus provide for automatic heating by selectively conducting current when the temperature of the concrete it is embedded in is below a setpoint of the device or switch. As also shown, the thermal switch 27 is wired in series with wire 26*b*, which provides power to the second electrode 23. Of course, any other suitable connection, such as connection to wire 26*a*, or both wires 26*a* and 26*b*, may also be used.

Figure 2:
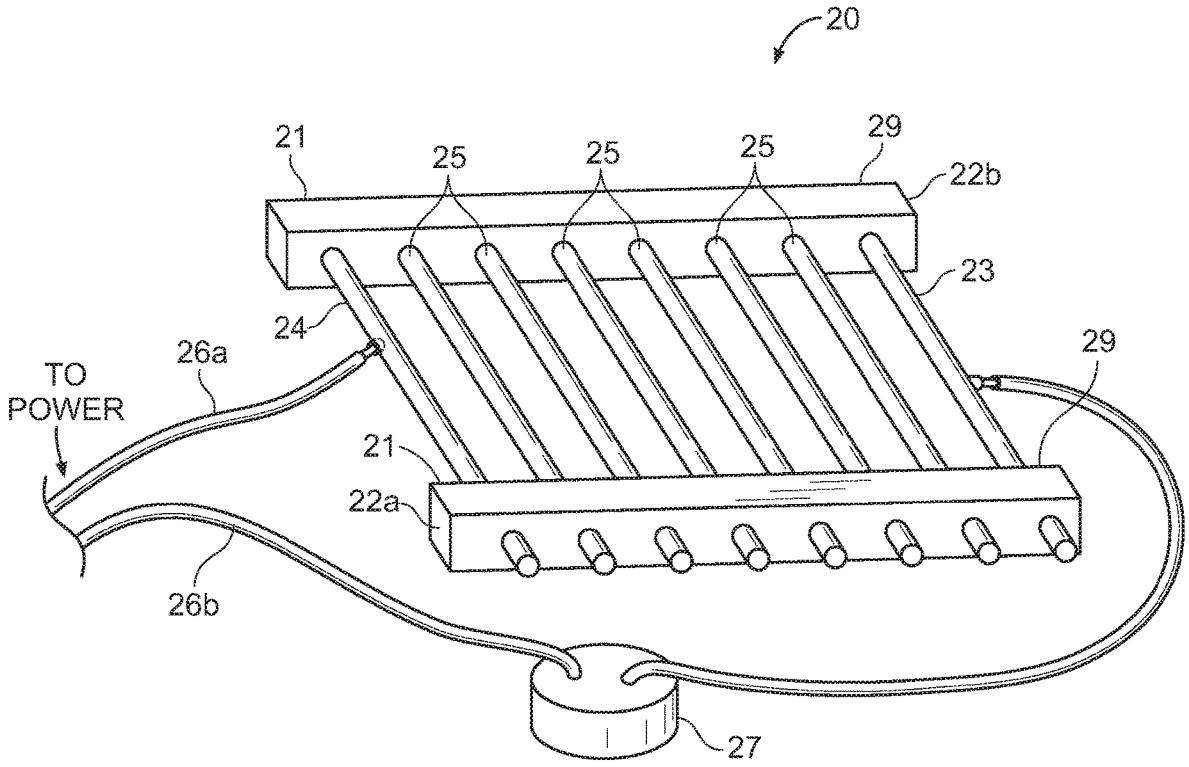
FIG. 2 is a perspective view of a heating device for use in a concrete heating system in accordance with an example embodiment.
Figure 3:
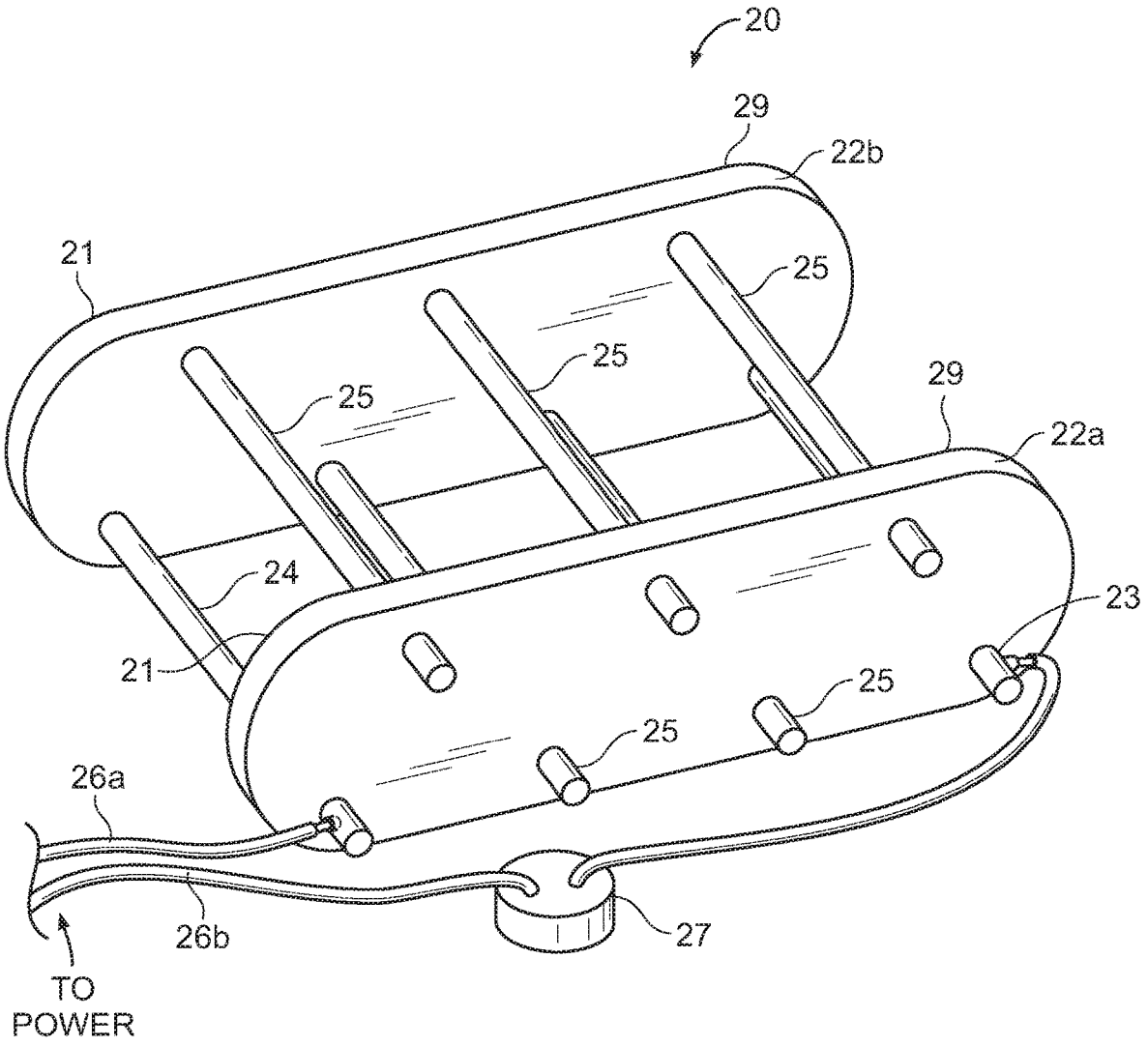
FIG. 3 is a perspective view of another heating device for use in a concrete heating system in accordance with an example embodiment.

Another example embodiment of the heating device is shown in FIG. 3, which is in the form of a double ladder. This embodiment is similar in operation to the embodiment of FIG. 2, but has conductors 25 positioned along two rows along the length of spacing members 22*a* and 22*b*. This embodiment provides for conduction of current through a thicker portion of conductive concrete when it is embedded. This embodiment is also usable with a thermal switch 27 or other control device to allow for automatic operation, wherein the heating device is selectively activated based on temperature, as described above. As also shown in FIG. 3, each of the plurality of conductors 25, as well as electrodes 24 and 23, form an angle with spacers 22*a* and 22*b*—in this embodiment, a right angle is shown, but again, other angles and configurations are possible.

Figure 7:
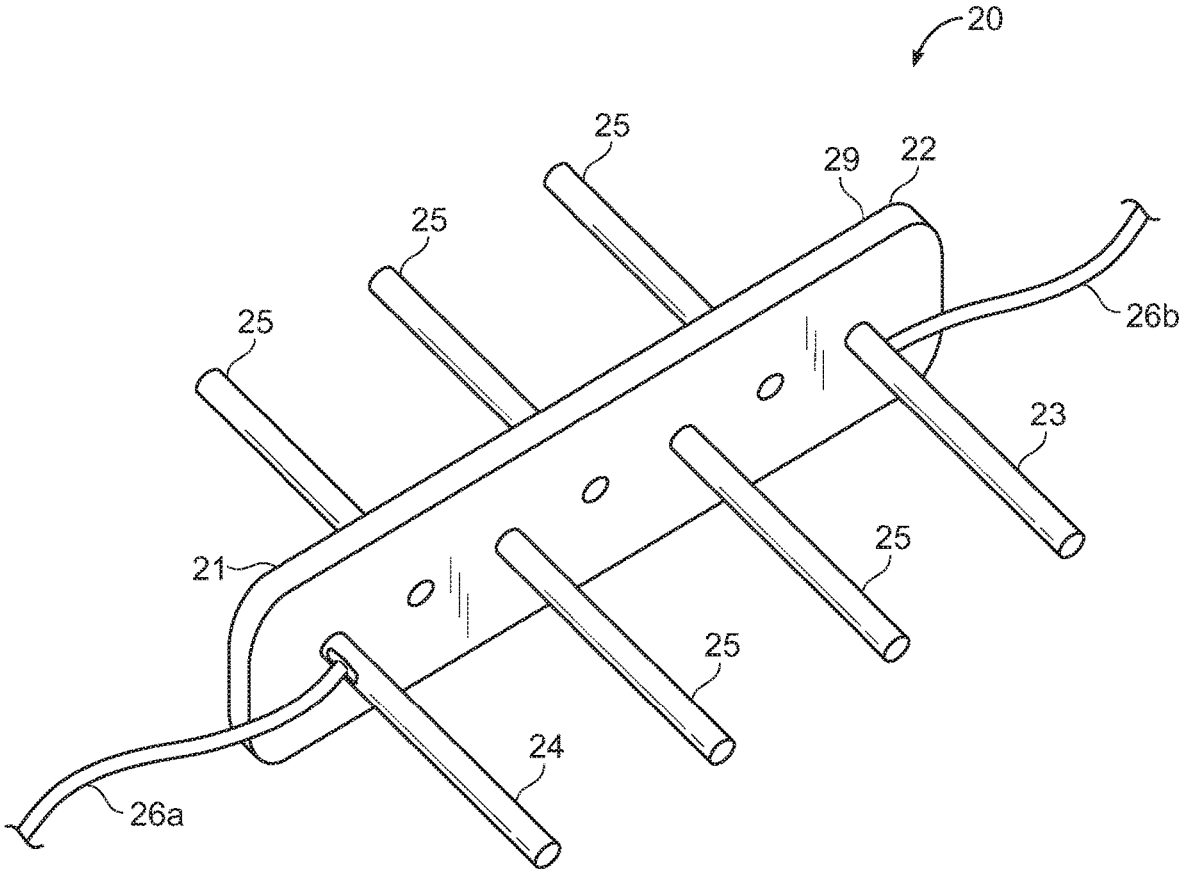
FIG. 7 is a perspective view of another heating device for use in a concrete heating system in accordance with an example embodiment.

Still another example embodiment of the heating device is shown in FIG. 7, which is in a different form than the previous examples. This embodiment is similar in operation to the embodiment of FIGS. 2 and 3, but has conductors 25 positioned along a single row and extending from opposite sides of a single spacing member 22. This embodiment provides for conduction of current through a wider portion of conductive concrete when it is embedded in the conductive concrete. This embodiment is also usable with a thermal switch 27 as described above. This embodiment also shows that each of the plurality of conductors 25, as well as electrodes 24 and 23, form a right angle with spacer 22, but other angles and configurations are possible. As one example, the electrodes and conductors 25 may extend away from the spacer 22 in a "V" configuration, such that the conductors are positioned like the cylinders in a V-8 engine. In such a configuration, the spacer may have a shape other than that shown, such as a V-shape with faces that are at an angle to each other (such as, for example, 90°, in which case the conductors 25 and electrodes 24, 23 would form an angle of 90° with respect to each adjacent conductor or electrode).

C. Conductive Blocks

Figure 4:
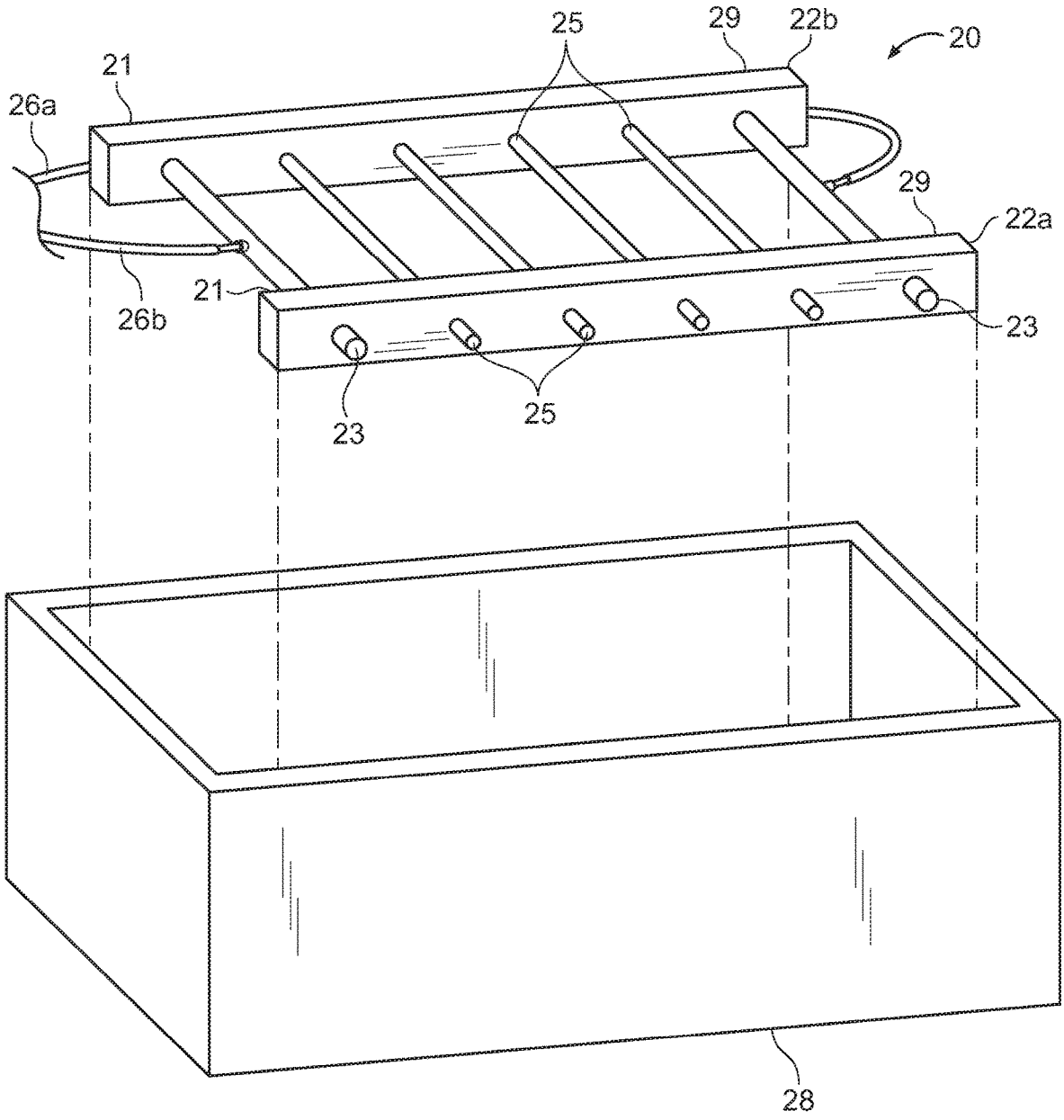
FIG. 4 is a perspective view of a heating device being embedded in conductive concrete for use in a concrete heating system in accordance with an example embodiment.
Figure 5:
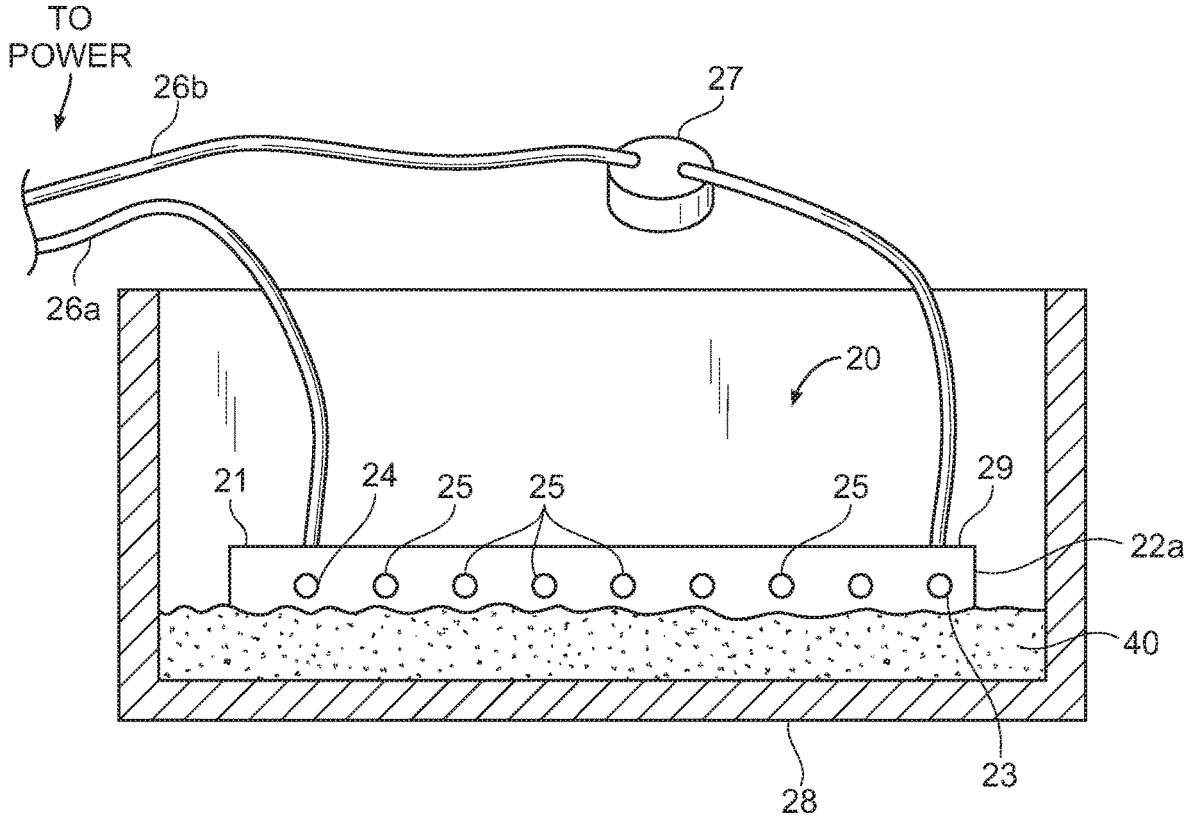
FIG. 5 is a cross section view of a heating device being embedded in conductive concrete for use in a concrete heating system in accordance with an example embodiment.

As discussed above, one or more heating devices 20 can be embedded in conductive concrete 40 to create conductive blocks 30 that can in turn be embedded in regular, nonconductive concrete to create a region or an entire area in a concrete structure where ice and snow can be melted using electrical power. This may be accomplished, for example, using a form 28, as illustrated in FIGS. 4-6. Initially, a layer of conductive concrete 40 may be placed in the form 28, as shown in FIG. 5. After the first layer is formed or cured, any embodiment of the heating device 20 can be placed on the layer, with the power wires 26*a* and 26*b* extending out of form 28. The conductive concrete 40 may be made in any number of ways, such as by "doping" regular concrete with conductive materials and thoroughly mixing the resulting concrete to incorporate the conductive material. In an example embodiment, the base concrete may be doped with fine, hair-like metal filaments. Such filaments may make contact with the conductors, and may even bridge from one conductor to the next adjacent conductor, thus improving current conduction in a path between the electrodes 23, 24 when a voltage is applied.

Next, another layer of conductive concrete 40*a* can be installed in the form 28 so that the heating device 20 is securely embedded within conductive concrete 40. Note that in FIG. 6, the conductive concrete on the top layer is labeled 40*a* simply to indicate that it is either uncured or initially allowed to cure after the first layer 40. As described, the heating device 20 is thus embedded well within the conductive concrete 40, and is spaced away from the bottom, top, and sides of the block 30. As best shown in FIGS. 5 and 6, thermal switch 27 may be held above the conductive concrete 40 so that it can later be embedded in a portion of regular or non-conductive concrete, to allow for automatic heating of a concrete structure. A thermal switch 27 may also be wired in series with any number of conductive blocks 30 of prefabricated concrete heating elements 14 (see below) to allow for simplified connections. In other words, a single thermal switch 27 may be used to automatically apply power to multiple elements, in which case a switch 27 will not be needed for each block 30 or prefabricated concrete heating element 14.

Once a conductive block 30 is formed, it may be embedded directly in a larger concrete structure, or it may be further embedded into a prefabricated concrete heating element 14 as described below. Any number of blocks 30 or prefabricated elements 14 may be embedded in a larger concrete structure to provide for electrically melting snow and ice on all or a part of the larger structure.

D. Prefabricated Concrete Heating Elements

Once a heating device 20 is embedded in conductive concrete 40 and cured to form a conductive block 30, the conductive block 30 may either be installed directly in a regular, non-conductive concrete structure, or it may be further embedded in a prefabricated concrete heating element 14, which is a self-contained unit which may have a built-in thermal switch 27. In addition, more than one heating device 30 and conductive block 30 may be embedded in concrete to form a prefabricated concrete heating element 14.

Figure 8:
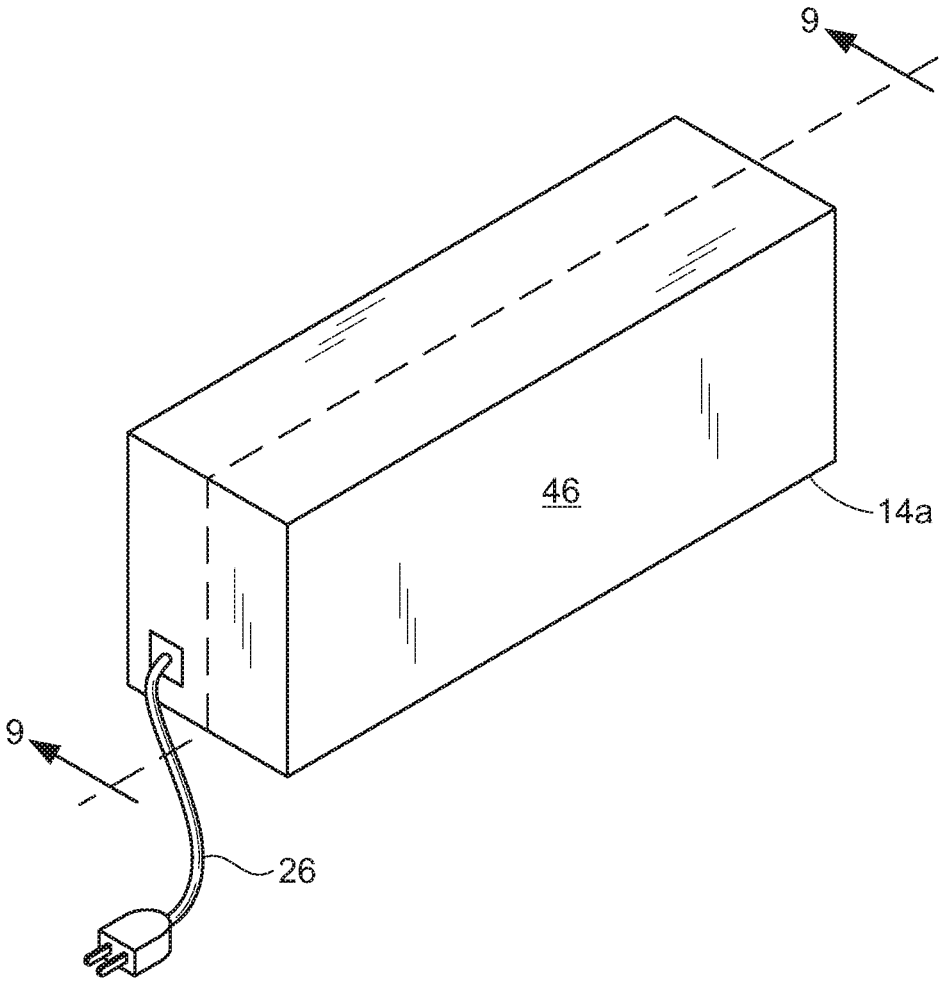
FIG. 8 is a perspective view of a prefabricated concrete heating element for use in a concrete heating system in accordance with an example embodiment.
Figure 9:
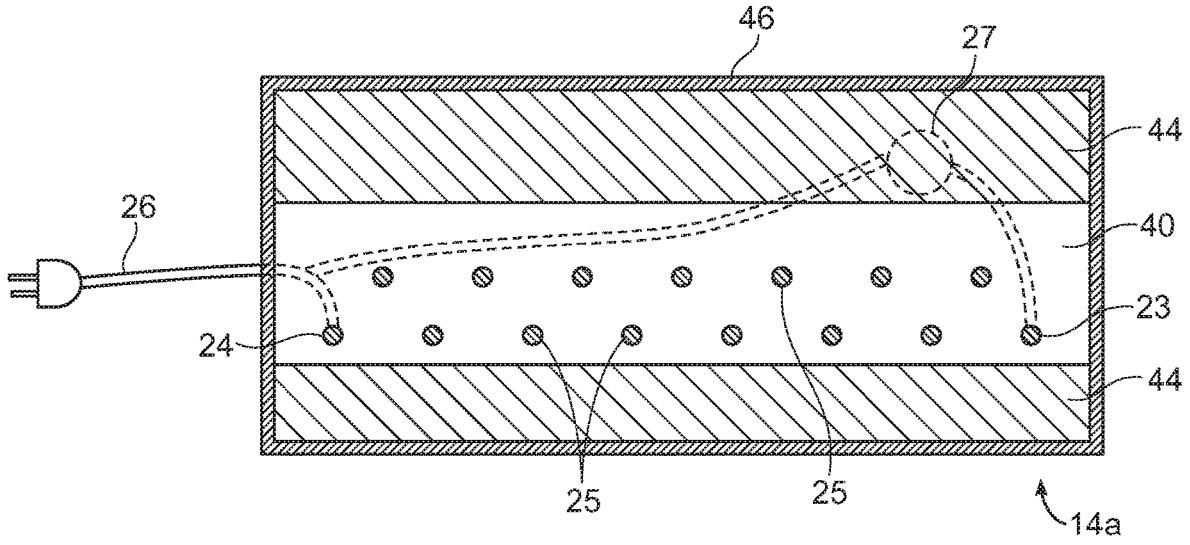
FIG. 9 is a section view of a prefabricated concrete heating element along the line 9-9 from FIG. 8 in accordance with an example embodiment.
Figure 10:
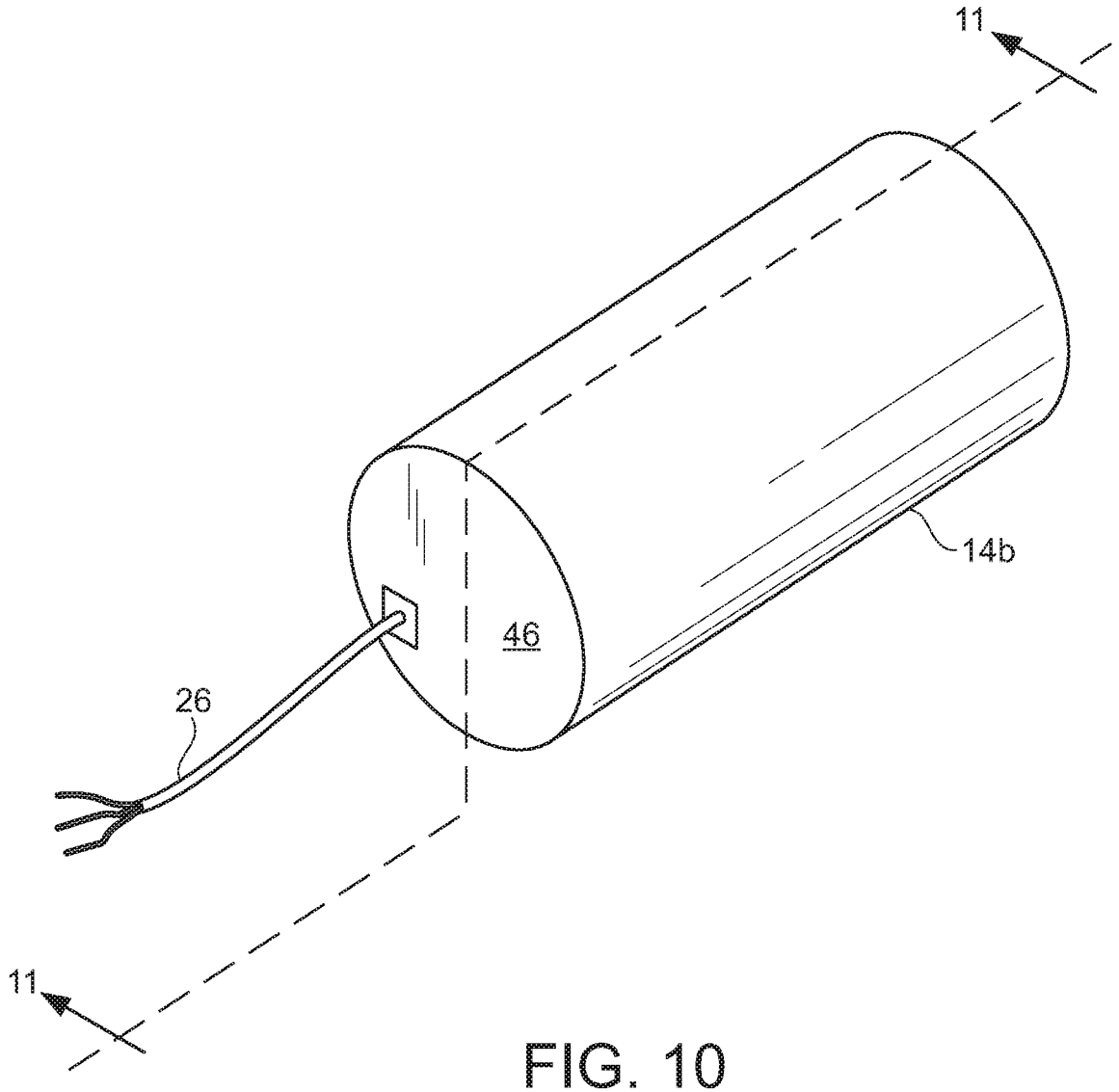
FIG. 10 is a perspective view of another prefabricated concrete heating element for use in a concrete heating system in accordance with an example embodiment.
Figure 11:
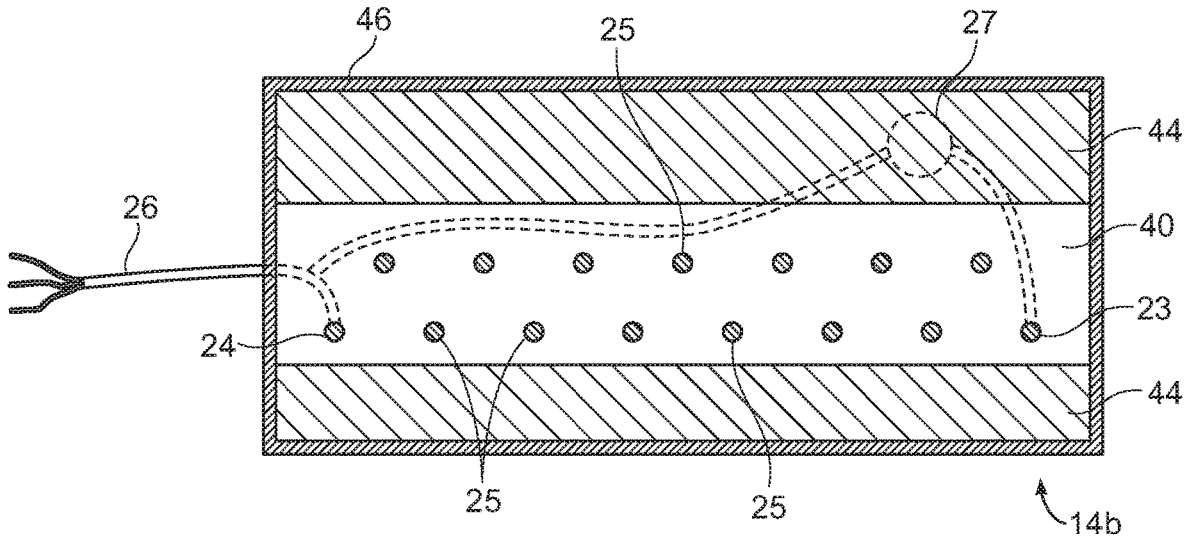
FIG. 11 is a section view of a prefabricated concrete heating element along the line 11-11 from FIG. 10 in accordance with an example embodiment.

An example prefabricated concrete heating element 14*a*, in the shape of a hexahedron, is shown in FIGS. 8 and 9. A similar prefabricated concrete heating element 14*b*, in a cylindrical shape, is shown in FIGS. 10 and 11. FIGS. 8 and 10 are perspective views of the elements, which can be formed and cured remotely from a final concrete structure. Prefabricated concrete heating element 14*a* has a power wire 26 exiting one side. In the embodiment shown, the wire 26 terminates in a conventional electrical plug, but the wire may also be left unterminated for permanent connection to a circuit, as shown in FIG. 1 (e.g., at connection point 13) and in the embodiment prefabricated concrete heating element 14*b*, shown in FIG. 10.

The prefabricated concrete heating elements 14*a*, 14*b* can be formed in a similar manner to the block 30, by first installing or forming a layer of non-conductive concrete 44 in the bottom of a form, the result of which is shown in the cross-section views of FIGS. 9 and 11. This layer may be any thickness relative to the overall size of prefabricated concrete heating element 14*a*, but in the embodiments shown, is about ⅓ of the total height of elements 14*a* and 14*b*. After the first layer of regular concrete is in place, a conductive heating block 30 can be placed on the layer, and then another layer of regular, non-conductive concrete 44 can be formed over block 30 and allowed to cure. As mentioned previously, this layer may include embedded thermal switch 27 to allow for automatic operation of the system 10.

As also shown in FIGS. 8-11, a prefabricated concrete heating element may further include an electrically insulated layer 46, so that the prefabricated concrete heating element is electrically isolated from the environment even after it is embedded in a larger concrete structure. This adds an extra level of safety, because the system 10 may be designed so that each prefabricated concrete heating element or conductive block is powered by 110 volts AC, although other operating voltages are also possible, including lower or higher AC or DC voltages.

E. Operation of Preferred Embodiment

As can be seen in FIGS. 2, 3, and 7, the conductors 25 of each heating device 20 provide additional surface area to contact conductive concrete 40 and improve conduction characteristics of a conductive block 30 made with one or more heating devices 20 embedded in conductive concrete 40. Accordingly, a pattern for melting snow and ice can be formed within a larger concrete structure, which may provide for more concentrated heating action (e.g., differing power densities) as compared to making an entire concrete structure out of conductive concrete. For example, as shown in FIG. 1, any number of prefabricated concrete heating elements 14 (such as 14*a* or 14*b*) can be embedded within a section of a structure 12, such as a driveway), to create a pathway leading away from the door that can be electrically heated to melt snow and ice, as indicated by the shaded region.

Of course, the heating system disclosed herein can also be used for heating an entire concrete or other structure, in which conductive blocks 30 or prefabricated concrete heating elements 14 can be embedded. Once blocks 30 or heating elements 14 are installed, the system can be powered, either by plugging one or more blocks 30 or prefabricated elements 14 into a conventional outlet, or, where a number of blocks 30 or elements 14 are hard-wired into one or more switched circuits, by actuating a switch, such as a light switch. As shown in FIG. 1, multiple elements 14 (or, alternatively, blocks 30) can be wired together serially or in parallel, depending on the design, before embedding in the concrete or other structure, in order to simplify wiring and installation of the system. Further, more than one ice melting zone can be created for a structure, simply by appropriate placement of blocks 30 or prefabricated elements 14 within the structure.

As also mentioned previously, the system 10 can include one or more thermal switches 27 to provide for automatic operation. For example, a thermal switch 27 usable with the system 10 may be a snap-action switch capable of switching 110 Volts directly, so that when the temperature falls below a predetermined setpoint, power is applied to the system. The power will remain on until the temperature of switch 27, which is typically embedded in an element 14, or within a larger structure 12, again rises above the setpoint. The system may also be used with a timer, with or without a thermal switch 27, in which case power can be applied to the system 10 between certain hours.

Unless otherwise defined, all technical and scientific terms used herein have the same meaning as commonly understood by one of ordinary skill in the art to which this invention belongs. Although methods and materials similar to or equivalent to those described herein can be used in the practice or testing of the concrete heating system, suitable methods and materials are described above. All publications, patent applications, patents, and other references mentioned herein are incorporated by reference in their entirety to the extent allowed by applicable law and regulations. The concrete heating system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A concrete heating device for embedding in conductive concrete, comprising:

a spacing member comprising a first end and a second end and a length between the first end and the second end;

a plurality of elongated conductors extending outward from the spacing member along the length, each of the plurality of conductors being spaced apart from each other;

a first electrode extending outward from the spacing member near the first end, the first electrode adapted for connection to a power source; and a second electrode extending outward from the spacing member, the second electrode being spaced apart from the first electrode and the plurality of conductors such that the plurality of conductors are positioned between the first electrode and the second electrode, the second electrode adapted for connection to the power source;

wherein the conductors are not conductively coupled to each other or to the first or second electrode; and wherein the plurality of conductors conduct an electrical current between the first electrode and the second electrode when the concrete heating device is embedded in conductive concrete and the power source applies a voltage between the first electrode and the second electrode.

2. The concrete heating device of claim 1, wherein the plurality of conductors are rod shaped, and extend outward at a right angle to an axis of the spacing member that extends between the first end and the second end.

3. The concrete heating device of claim 1, wherein the spacing member comprises a first spacing member, the concrete heating device further comprising a second spacing member spaced apart from the first spacing member, the second spacing member comprising a first end and a second end and a length between the first end and the second end, and wherein the first electrode, the second electrode, and the plurality of conductors are elongated and extend between the first spacing member and the second spacing member along the length of the first spacing member and along the length of the second spacing member.

4. The concrete heating device of claim 3, wherein the first spacing member and the second spacing member are parallel to each other.

5. The concrete heating device of claim 3, wherein the first electrode, the second electrode, and the plurality of conductors are parallel to each other and lie substantially in single row along the length of the first spacing member and the second spacing member.

6. The concrete heating device of claim 5, wherein the first spacing member and the second spacing member are parallel to each other such that the first spacing member, the second spacing member, and the plurality of conductors form a ladder-like structure.

7. The concrete heating device of claim 3, wherein the plurality of conductors are parallel to each other and lie substantially in two rows spaced apart from each other.

8. The concrete heating device of claim 7, wherein the first spacing member and the second spacing member are parallel to each other.

9. The concrete heating device of claim 1, wherein the first electrode and the second electrode are connectable to the power source by a first wire and a second wire conductively coupled to the first electrode and the second electrode, and wherein the concrete heating device further comprises a thermal switch connected in series with the first wire or the second wire such that the thermal switch selectively conducts or interrupts the electrical current that flows through the concrete heating device based on temperature.

10. A method of using the concrete heating device of claim 9, comprising:

embedding the concrete heating device in conductive concrete;

allowing the conductive concrete to cure;

connecting the first wire and the second wire to the power source; and activating the power source such that the voltage is applied between the first electrode and the second electrode.

11. A method of using the concrete heating device of claim 1, wherein the first electrode is connectable to the power source by a first wire, and wherein the second electrode is connectable to the power source by a second wire, the method comprising:

embedding the concrete heating device in conductive concrete;

allowing the conductive concrete to cure;

connecting the first wire and the second wire to the power source; and activating the power source such that the voltage is applied between the first electrode and the second electrode.

12. The method of claim 11, wherein allowing the conductive concrete to cure creates a conductive block, the method further comprising embedding the conductive block in non-conductive concrete;

wherein the conductive block provides heat that is transferred into the non-conductive concrete.

13. A prefabricated concrete heating element for embedding in concrete, comprising:

a concrete heating device comprising:

a spacing member comprising a first end and a second end and a length between the first end and the second end;

a plurality of elongated conductors extending outward from the spacing member along the length, each of the plurality of conductors being spaced apart from each other;

a first electrode extending outward from the spacing member near the first end, the first electrode adapted for connection to a power source; and a second electrode extending outward from the spacing member, the second electrode being spaced apart from the first electrode and the plurality of conductors such that the plurality of conductors are positioned between the first electrode and the second electrode, the second electrode adapted for connection to the power source;

wherein the conductors are not conductively coupled to each other or to the first or second electrode;

a cured, conductive concrete portion that surrounds the concrete heating device;

a cured, non-conductive concrete portion that at least partially surrounds the cured, conductive concrete portion;

an insulation layer that encloses the cured, non-conductive concrete portion and the cured, conductive concrete portion;

wherein the plurality of elongated conductors and the cured, conductive concrete portion conduct an electrical current between the first electrode and the second electrode when the power source applies a voltage between the first electrode and the second electrode.

14. The prefabricated concrete heating element of claim 13, further comprising a first wire and a second wire extending from the prefabricated concrete heating element and connected to the first electrode and the second electrode, respectively, the first wire and the second wire connectable to the power source.

15. The prefabricated concrete heating element of claim 14, further comprising a thermal switch positioned within the cured, non-conductive concrete portion and connected in series between the power source and the first electrode or the second electrode, such that the thermal switch selectively conducts or interrupts the electrical current that flows through the concrete heating device based on temperature.

16. The prefabricated concrete heating element of claim 13, wherein the prefabricated concrete heating element is in the shape of a hexahedron.

17. The prefabricated concrete heating element of claim 13, wherein the prefabricated concrete heating element is in the shape of a cylinder.

18. A method of using the prefabricated concrete heating element of claim 13, wherein the first electrode is connectable to the power source by a first wire, and wherein the second electrode is connectable to the power source by a second wire, the method comprising:

embedding the prefabricated concrete heating element in uncured concrete;

allowing the uncured concrete to cure;

connecting the first wire and the second wire to the power source; and activating the power source such that the voltage is applied between the first electrode and the second electrode.

19. The prefabricated concrete heating element of claim 13, wherein the spacing member of the concrete heating device comprises a first spacing member, and wherein the concrete heating device further comprises a second spacing member spaced apart from the first spacing member, and wherein the first electrode, the second electrode, and the plurality of conductors are elongated and extend between the first spacing member and the second spacing member.

20. A system for heating a concrete structure, comprising:

a prefabricated concrete heating element embedded in the concrete structure, comprising:

a concrete heating device comprising:

a first spacing member comprising a first end and a second end and a length between the first end and the second end;

a second spacing member comprising a first end and a second end and a length between the first end and the second end;

wherein the first spacing member is spaced apart from and parallel to the second spacing member, and wherein the first end of the first spacing member corresponds to the first end of the second spacing member;

a plurality of elongated conductors extending between the first spacing member and the second spacing member, the plurality of elongated conductors spaced apart from each other along the length of the first spacing member and the second spacing member;

a first electrode extending between the first and second spacing members near their first ends, the first electrode adapted for connection to a power source; and a second electrode extending between the first and second spacing members near their second ends, the second electrode being spaced apart from the first electrode and the plurality of conductors such that the plurality of conductors are positioned between the first electrode and the second electrode, the second electrode adapted for connection to the power source;

wherein the conductors are not conductively coupled to each other or to the first or second electrode;

a cured, conductive concrete portion that surrounds the concrete heating device;

a cured, non-conductive concrete portion that at least partially surrounds the cured, conductive concrete portion such that the prefabricated concrete heating element has a hexahedron shape;

a thermal switch positioned in the cured, non-conductive concrete portion, the thermal switch connected between the power source and the first electrode or the second electrode such that the thermal switch selectively closes to conduct or opens to interrupt an electrical current that flows through the concrete heating device, based on temperature; and an insulation layer that encloses the cured, non-conductive concrete portion and the cured, conductive concrete portion;

wherein the plurality of conductors and the cured, conductive concrete portion conduct the electrical current between the first electrode and the second electrode when the power source applies a voltage between the first electrode and the second electrode when the thermal switch is closed.

* * * * *